US005282767A

United States Patent [19]

Gelardi

[11] Patent Number: 5,282,767

[45] Date of Patent: Feb. 1, 1994

[54] CONSTRUCTION SETS WITH INJECTION MOLDED AND EXTRUDED TUBE BEAMS

[76] Inventor: John A. Gelardi, P.O. Box 714, Kennebunkport, Me. 04046

[21] Appl. No.: 2,950

[22] Filed: Jan. 11, 1993

[51] Int. Cl.[5] ..... A63H 33/08; A63H 33/06

[52] U.S. Cl. ..... 446/126; 446/121; 446/107

[58] Field of Search ..... 446/126, 127, 128, 125, 446/121, 120, 118, 117, 116, 110, 109, 108, 107, 124, 85

[56] References Cited

U.S. PATENT DOCUMENTS

| | | | |
|---|---|---|---|
| 144,124 | 10/1873 | Oberndorf, Jr. | 446/124 X |
| 1,216,840 | 2/1917 | Ramsey et al. . | |
| 1,281,856 | 10/1918 | Shaw | 446/124 X |
| 2,147,373 | 2/1939 | Laird | 446/124 |
| 2,799,119 | 7/1957 | Cullp | 446/121 X |
| 2,885,822 | 5/1959 | Onanian . | |
| 2,937,471 | 5/1960 | Parisi | 446/127 X |
| 3,168,793 | 2/1965 | Gibson | 446/126 X |
| 3,528,079 | 9/1970 | Birch . | |
| 3,545,123 | 12/1970 | Muller | 446/126 X |
| 3,638,352 | 2/1972 | Christiansen | 446/120 |
| 3,640,018 | 2/1972 | Light . | |
| 3,890,022 | 6/1975 | Moon . | |
| 3,940,142 | 2/1976 | Hinz et al. . | |
| 4,003,144 | 1/1977 | Maddestra et al. . | |
| 4,129,975 | 12/1978 | Gabriel . | |
| 4,170,082 | 10/1979 | Freedman . | |
| 4,484,407 | 11/1984 | Petersson . | |
| 5,061,219 | 10/1991 | Glickman | 446/126 |
| 5,120,253 | 6/1992 | Gelardi | 446/126 X |

FOREIGN PATENT DOCUMENTS

| | | | |
|---|---|---|---|
| 113975 | 2/1961 | Canada | 446/116 |
| 825518 | 12/1951 | Fed. Rep. of Germany . | |
| 2129763 | 12/1972 | Fed. Rep. of Germany . | |
| 2154544 | 5/1973 | Fed. Rep. of Germany . | |
| 2638969 | 3/1977 | Fed. Rep. of Germany | 446/124 |
| 613144 | 11/1960 | Italy . | |
| 281162 | 2/1952 | Switzerland . | |
| 176013 | 3/1922 | United Kingdom | 446/120 |
| 798278 | 7/1958 | United Kingdom . | |
| 1238975 | 7/1971 | United Kingdom . | |

*Primary Examiner*—David N. Muir
*Attorney, Agent, or Firm*—James C. Wray

[57] ABSTRACT

A construction toy system comprises straight and curved tube beams and injection molded beams. The beams have joint end in the continuation of the bodies. The joint ends area separated from the bodies by flanges surrounding the edge of the beams. The flanges are created to prevent the beams from pushing through when connected to connectors. The connectors comprise plural cubes with six cylindrical receivers to where the beams are connected, creating structures from the beams. The receivers have an aperture equivalent to the joint ends of the beams and each receiver incorporates an interior surface for holding the joint ends of the beams.

15 Claims, 4 Drawing Sheets

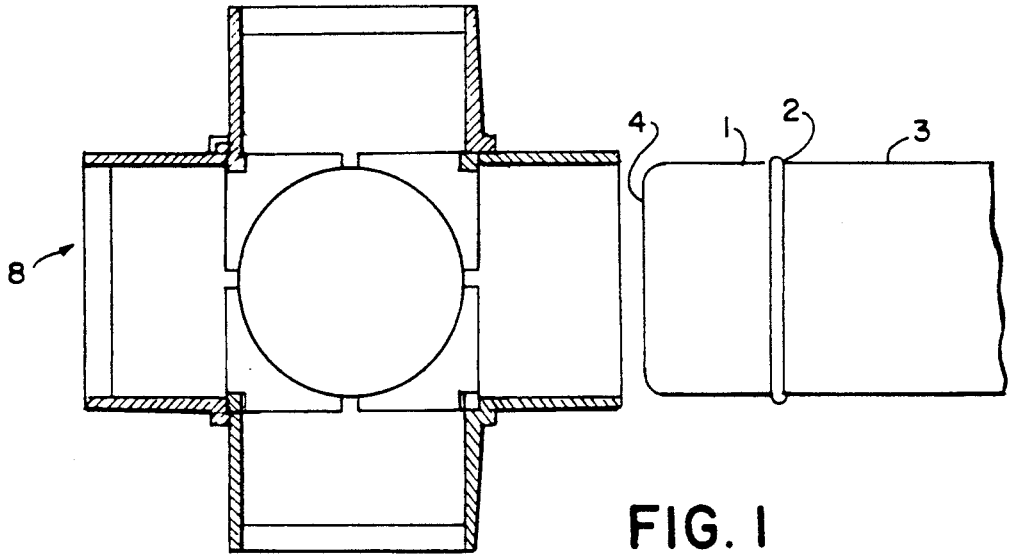
FIG. 1
FIG. 2
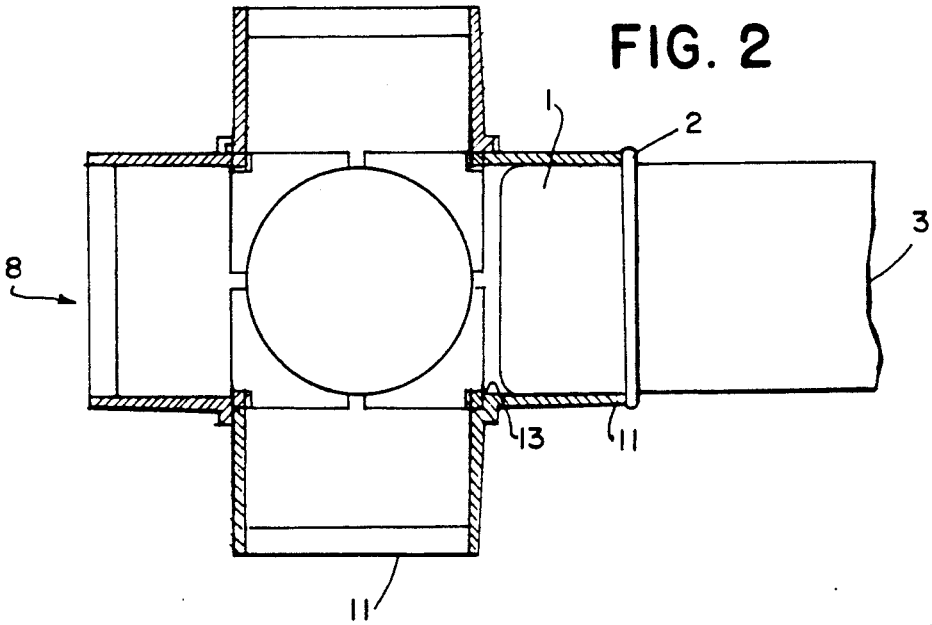
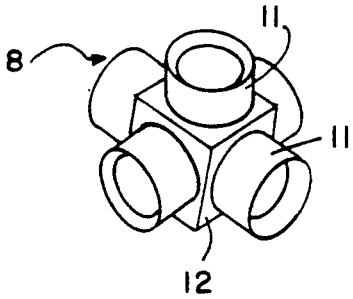
FIG. 3

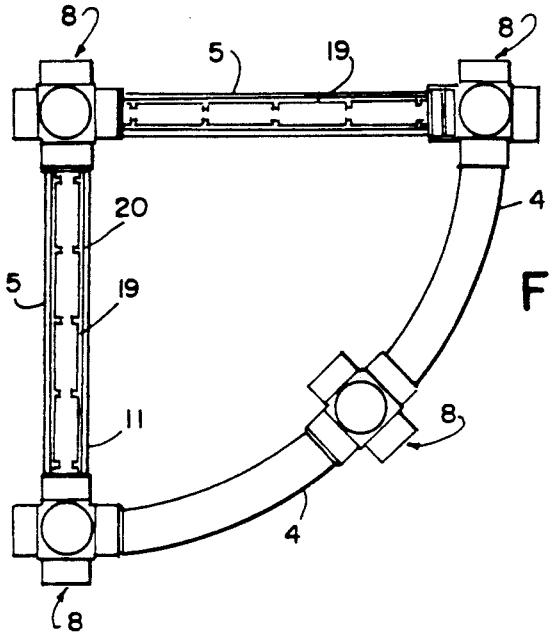
FIG. 4
FIG. 5
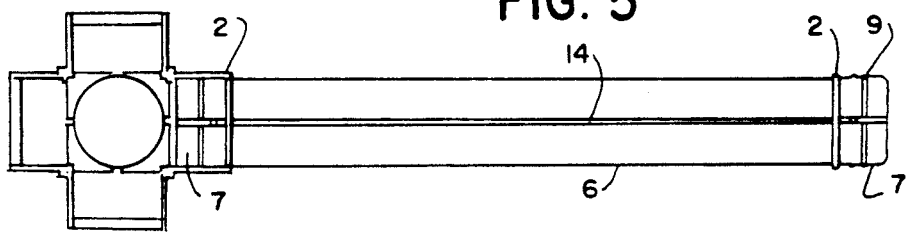
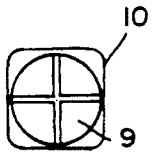
FIG. 6
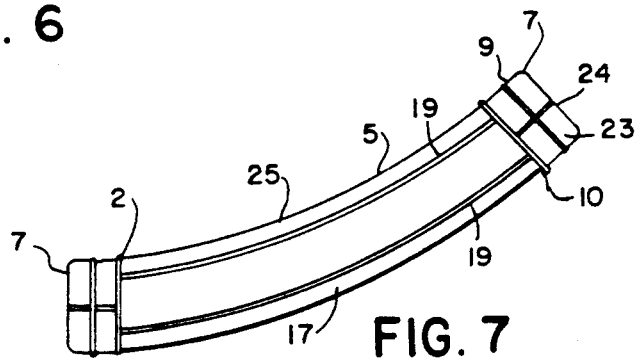
FIG. 7

CONSTRUCTION SETS WITH INJECTION MOLDED AND EXTRUDED TUBE BEAMS

BACKGROUND OF THE INVENTION

A need exists for construction sets which children of all may construct toys and useful structures.

U.S. Pat. No. 5,120,253 discloses a construction connector system for creating structures from plastic bottles. Although plastic bottles are durable materials, they may not generally be perceived as reliable building materials for construction of toys or useful structures.

Collection or accumulation of a sufficient number of empty plastic soft drink or soda bottles requires time and space and delays the use of the construction set when a box is opened. Bottles are of varied sizes requiring imagination in assembling structures when different size bottles have been collected.

A need existed for devices which are immediately available for use in building systems.

SUMMARY OF THE INVENTION

Injection molded and extruded tube beams of the present invention have been created to solve the need.

A construction toy system includes straight and curved beams. The beams have straight joint ends in continuation of the beam bodies. The connector joint ends are separated by flanges surrounding the intersections of the beam bodies and the joint ends of the beams. The flanges are created to prevent the beams from pushing through when connected to connectors. Preferred connectors are plural cubes. Each cube has six cylindrical receivers to which the beams are connected, creating structures from the beams. The receivers have apertures equivalent to the joint ends of the beams. Each receiver incorporates an interior surface for holding the joint ends of the beams.

The invention provides straight and curved beams, preferably in the form of either tubular beams or injection molded beams. Both types have flanges on both ends to be used in a construction system for creating structures from such beams. The beams have heads on both ends delineated by flanges. The flanges on both heads prevent the beams from pushing through connectors when connected with one of the ends of the connector. Preferably, the heads are of cruciform shape and narrower than the width of the flanges.

The present invention provides a construction toy system, having cubic connectors and having elongated beams with central bodies and joint ends in continuation of the bodies and separated from the bodies by flanges for inserting joint ends into connectors and for limiting insertion of the joint ends into the connectors by the; flanges, for interconnecting the beams in end-to-end relationship in the connectors.

In one embodiment the beams are straight and curved extruded tubes with hoop-like flanges on both ends for use with construction system connectors for creating structures from the tubes.

In another preferred embodiment the beams are constructed as straight and curved injection molded beams with thin crossed webs having flat longitudinally extending lateral surfaces flanges near both ends for use in the construction system connectors for creating imaginative structures from the beams and connectors.

The joint ends have heads on both ends of the beams delineated by the flanges. The flanges in both heads prevent the beams from pushing through the connectors when joined with the connectors of the construction system. The preferred heads have cruciform cross-sectional shape, with thin webs extending outwardly less than the width of the flanges. The heads contain disks between the flanges and the ends of the beams which give stability to edges of the beams as they frictionally contact the connectors.

Heads on both ends of the beams are separated from long center of the injection molded beam by flanges. Preferred heads are of square shape, narrower than the width of the flange on the outside. The heads contain disks between the flanges and the ends of the beams which give stability to the edges as they frictionally contact the connectors. A preferred interference fit between the outer edges of the thin webs and disks and the inner walls of the receivers allows smooth, quick and sure assembly and disassembly without undue binding. The result is a rigid structure which is easily assembled and disassembled, but which remains assembled until intentionally disassembled.

Preferably each of the molded beams has a longitudinally end-to-end extending vertical member and two parallel cross-members extending across the vertical member for forming the injection molded beam.

The preferred kit includes plural six-cavity connectors in the construction system for creating structures from the beams. The connectors cubes are subdivided into six equivalent square panels. Each of the panels incorporates an outwardly extending cylinder. Each cylinder has an aperture equivalent to outer dimensions of the webs and disks of the joint ends of the beams. Each cylinder has an interior cylindrical surface for gripping the webs and disks joint ends of the beams. Each cube provides receivers for holding six beams extending therefrom.

These and further and other objects and features of the invention are apparent in the disclosure, which includes the above and ongoing written specification, with the claims and drawings.

BRIEF DESCRIPTION OF THE DRAWINGS

FIG. 1 is a partial sectional unassembled view of the connector of the construction system and an end of the straight tube beam.

FIG. 2 is a partial sectional assembled view of the connector of the construction system and the straight tube beam connected to the connector.

FIG. 3 is a perspective view of the six-cavity connector used in the present construction system.

FIG. 4 is an assembled view of a structure created with four connectors, two straight molded beams and two curved tube beams.

FIG. 5 is a view of a straight single cross-member injection molded beam having one joint end connected to a connector of the construction system, shown in cross-section.

FIG. 6 is an end view of a joint end of a beam.

FIG. 7 is a view of a curved injection molded beam with two parallel cross-members.

DETAILED DESCRIPTION OF THE DRAWINGS

Figure 8:
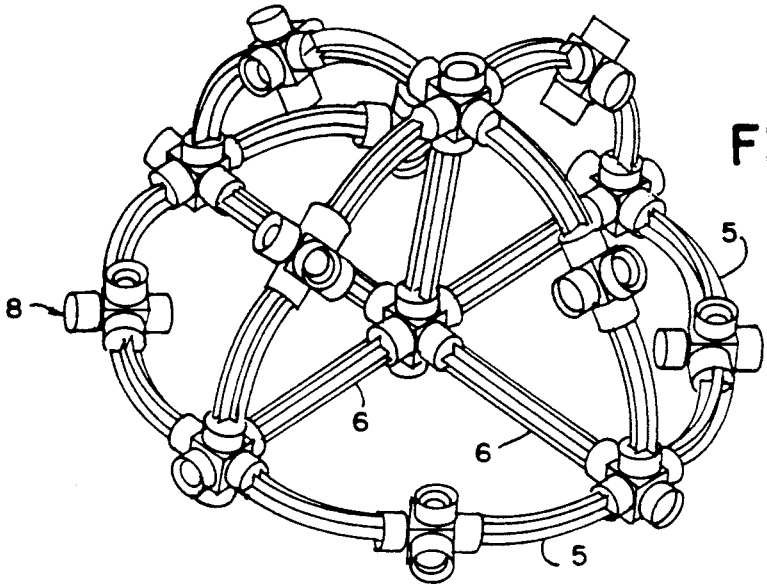
FIG. 8 is a perspective view of a structure created using straight and curved molded beams and connectors of the construction system.

Referring to FIG. 1, a connector is generally referred to by the numeral 8. The body of the straight tube beam is referred to by the numeral 3. Tube beams are formed by a central body 3, joint ends 1, and flanges 2. The joint ends are continuations of the central body, separated by the flanges. The extreme end 4 may be chamfered or rounded to aid insertion of the joint end into the connector.

FIG. 2 shows the straight tube beam 3, connected to one of the cylinders 11 of the connector. The joint end 1 is pushed into the cylinder. The cylinder incorporates an interior surface 13 for holding the outer surface of joint end 1 of the tube beam. The flanges 2 circumscribe the edges of the beams and are wider than the body and ends of the beams to prevent the beam from overinsertions or pushing through the cylinders 11.

In the case of the tube beams, the flanges may be added at intervals along an extrusion while the tubes are being extruded. The flanges may be formed by upsetting the tube in a die or by adding and shrinking or bonding hoops after the tube is formed.

FIG. 3 is a perspective view of the connector 8. The connector has six square panels 12. Each panel incorporates an outwardly extending cylinder 11. Each cylinder holds a joint end of the beams. The connectors allow structures to be created by supporting and holding ends of the beams.

A small structure formed by connectors 8, straight molded beams 5, and curved tube beams 4, is shown in FIG. 4.

FIG. 5 shows an injection molded beam 6 with one-single cross-member 14 having one of the joint ends 7 connected to one of the cylinders of the connector. The end view of the joint end of the injection molded beam is shown in FIG. 6. The joint-ends of the molded beams are of square shape and narrower than the flanges. The joint ends contain disks between the flanges and the ends of the beams created to give stability to edges of the beams and to engage the inner walls of the connector cylinder.

FIG. 7 is a view of a preferred injection molded beam with two parallel cross members. A longitudinally end-to-end extending vertical cross member 17 has two parallel cross members 19 extending across the vertical member to form the injection molded beam 15.

The two parallel cross webs 19 may have small triangular or beaded gussets 20 as shown in FIG. 4. The end structure 21 shown in FIG. 7 has an extension 23 of the main member 17. A singles cross member 24 jointed in a cruciform relationship, a disc 9 and square flange 10, as shown in the end of FIG. 6. The central section 25 of the beam has web tip portions which extend outward in substantially equal distance from where they joint with other webs.

A perspective view of a structure construed with connectors and straight and curved molded beams is shown in FIG. 8.

Figure 9:
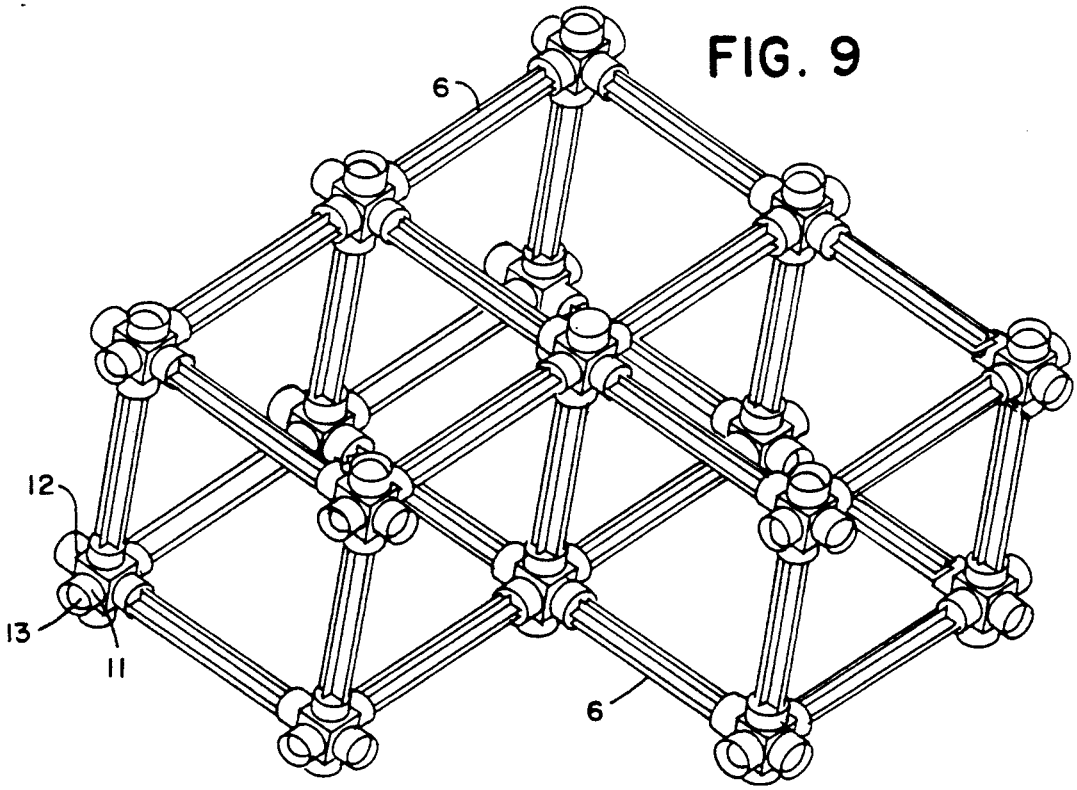
FIG. 9 is a perspective view of a structure created using straight molded beams and six-cavity connectors of the construction system.

FIG. 9 shows a perspective view of a structure construed with connectors and straight molded beams.

Figure 10:
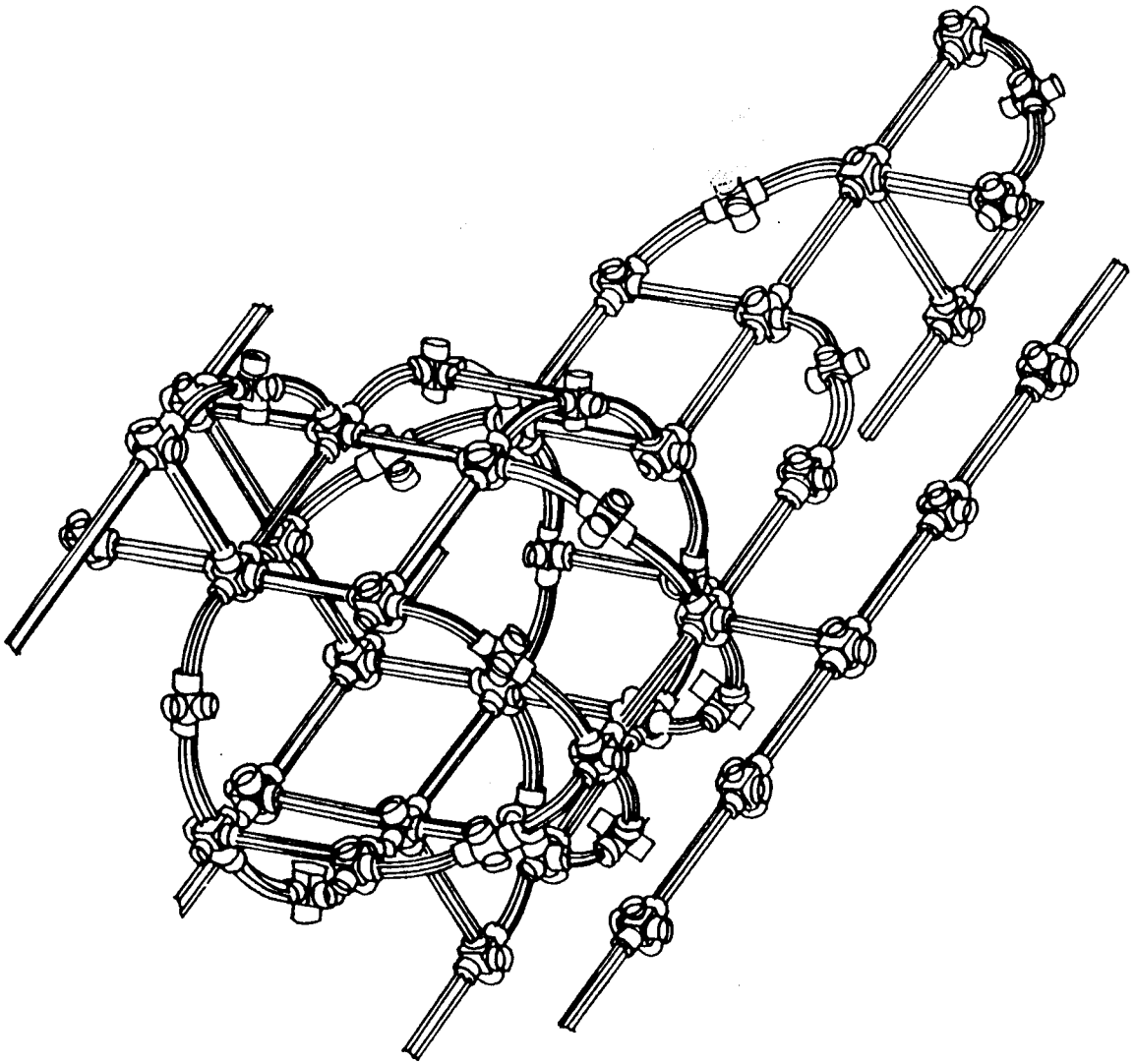
FIG. 10 is a cross-sectional view of a structure using straight and curved molded beams and the six-cavity connectors.

A structure construed with straight and curved molded beams and connectors is shown in FIG. 10.

While the intention has been described with reference to specific embodiments, modifications and variations of the invention may be constructed without departing from the scope of the invention, which is defined in the following claims.

I claim:

1. Construction apparatus comprising a combination of apertured connectors and elongated beams having central bodies and having joint ends in continuation of the bodies and separated from the bodies by flanges perpendicular to a longitudinal axis of the beams, at least one of said joint ends comprising intersecting webs with at least one disk extending through the webs, for inserting joint ends into connectors and for limiting insertion of the joints ends into the connectors by the flanges, for interconnecting the beams in end-to-end relationship in the connectors and creating three-dimensional structures.

2. The apparatus of claim 1, wherein the beams further comprise straight and curved extruded tubes with the flanges near both ends for use in a construction system for creating structures from the tubes.

3. The apparatus of claim 1, wherein the beams comprise straight and curved injection molded beams with thin webs having flat longitudinally extending lateral surfaces, with the flanges being positioned near both ends for use in a construction system for creating structures from the beams.

4. The apparatus of claim 3, wherein the joint ends further comprise heads on both ends of the beams delineated by the flanges, the flanges in both heads being created to prevent the beams from pushing through the connectors when connected with the connectors of the construction system, the heads having axially crossed webs defining a cruciform cross sectional shape and being radially narrower than a width of the flange.

5. The apparatus of claim 3, wherein the joint ends comprise heads on both ends of the beams separated from the injection molded beam bodies by flanges, the heads further comprising intersecting webs which are narrower than the width of the flange and disks extending through the webs between the flanges and the ends of the beams, which are created to give stability to edges of the webs and to the joint ends of the beams.

6. The apparatus of claim 3, wherein each of the beams further comprises a longitudinally end-to-end extending vertical member and one transverse member forming the injection molded beam.

7. The apparatus of claim 3, wherein each of the beams further comprises a longitudinally end-to-end extending vertical member and two parallel transverse members extending across the vertical member and forming the injection molded beam.

8. The apparatus of claim 1, further comprising plural six-cavity connector cubes, forming a construction system for creating structures form the beams, wherein the connector cubes are subdivided into six equivalent square panels, each of the panels incorporating an outwardly extending cylinder, wherein each cylinder has an aperture equivalent to the joint ends of the tube beams and each cylinder incorporates an interior surface for holding the joint ends of the beams, each of said cubes providing six cylinders for holding six beams extending therefrom.

9. A construction system apparatus comprising elongated beams having central bodies and having joint ends in continuation of the bodies and separated from the bodies by flanges for inserting joint ends into connectors and for limiting insertion of the joint ends into the connectors by the flanges, for interconnecting the beams in end-to-end relationship in the connectors; wherein the connectors of said construction system comprise plural six-cavity connector cubes for creating structures from the beams, the cubes being subdivided into six equivalent square panels, each of the panels incorporating an aperture having a size equivalent to the joint ends of the beams and each cylinder having an interior surface for holding the joint ends of the beams, the cylinders protruding from sides of the panels, with the cylinders extending outward, mating snaps on edges of the panels, each of said cubes having six cylinders for holding six beams extending therefrom.

10. The apparatus of claim 9, wherein the beams comprise straight and curved extruded tubes with the flanges near ends of the tubes for use in the construction system for creating structures with the tubes and cubes.

11. The apparatus of claim 9, wherein the beams comprise injection molded beams intersecting webs with thin cross-sections and flat longitudinally extending lateral surfaces, with flanges near both ends for use in the construction system for creating structures with the beams and cubes.

12. The apparatus of claim 11, wherein the joint ends further comprise heads on both ends of the beams delineated by the flanges, the flanges on the heads being created to prevent the heads and the beams from pushing through the cylinders when connected with the connector cubes of the construction system, the heads being of cruciform cross-sectional shape narrower than the width of the flanges.

13. The apparatus of claim 11, further comprising heads on both ends of the beams separated from central portions of the injection molded beam by flanges, the heads having webs joined in cruciform cross-sectional shapes, having radial dimensions narrower than the width of the flange and containing disks transversing the head webs between the flanges and the ends of the beams for providing stability to edges of the webs on the heads of the beams.

14. The apparatus of claim 9, wherein each of the beams further comprises a central body portion having a longitudinally end-to-end extending vertical member and two parallel transverse members integrally forming the injection molded beam.

15. The apparatus of claim 9, wherein each of the beams further comprises a longitudinally end-to-end extending vertical member and a parallel cross-member integrally forming the injection molded beam.

* * * * *